US006398354B1

(12) United States Patent
Lattuca et al.

(10) Patent No.: US 6,398,354 B1
(45) Date of Patent: Jun. 4, 2002

(54) PRINTHEAD APPARATUS AND PRINTER HAVING SEPARATE FILTRATION DEVICE AND METHOD FOR ATTACHING SAID DEVICE

(75) Inventors: Michael David Lattuca, Lexington; David Amos Ward, Cynthiana; Richard Earl Corley, Jr., Lexington; Carl Edmond Sullivan, Versailles; Paul Timothy Spivey, Nicholasville, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/345,281

(22) Filed: Jun. 30, 1999

(51) Int. Cl.[7] ..... B41J 2/175
(52) U.S. Cl. ..... 347/93
(58) Field of Search ..... 347/93, 92, 85, 347/86

(56) References Cited

U.S. PATENT DOCUMENTS

| | | | | | |
|---|---|---|---|---|---|
| 3,708,118 | A | | 1/1973 | Keur | |
| 4,153,902 | A | | 5/1979 | Kanayama | |
| 4,603,890 | A | * | 8/1986 | Huppee | 385/239 |
| 4,628,334 | A | | 12/1986 | Dagna et al. | |
| 4,946,204 | A | * | 8/1990 | Boticki | 285/281 |
| 5,017,941 | A | * | 5/1991 | Drake | 347/67 |
| 5,119,115 | A | | 6/1992 | Buat et al. | |
| 5,425,478 | A | | 6/1995 | Kotaki et al. | |
| 5,456,248 | A | * | 10/1995 | Holian et al. | 128/205.12 |
| 5,515,091 | A | | 5/1996 | Kimura et al. | |
| 5,537,136 | A | | 7/1996 | Brandon et al. | |
| 5,546,109 | A | | 8/1996 | Nakano | |
| 5,606,988 | A | | 3/1997 | Pawlowski, Jr. | |
| 5,696,546 | A | | 12/1997 | Narang et al. | |
| 5,751,322 | A | | 5/1998 | Miller et al. | |
| 5,767,881 | A | | 6/1998 | Geissmann | |
| 5,777,646 | A | | 7/1998 | Barinaga et al. | |
| 5,815,182 | A | | 9/1998 | Otis et al. | |
| 5,828,395 | A | * | 10/1998 | Takata | 347/86 |
| 5,905,518 | A | | 5/1999 | DeFilippis | |
| 5,936,650 | A | * | 8/1999 | Ouchida et al. | 347/89 |
| 6,074,049 | A | * | 6/2000 | Mächler | 347/86 |

FOREIGN PATENT DOCUMENTS

| | | | | |
|---|---|---|---|---|
| EP | 0 676 294 A2 | | 4/1995 | |
| JP | 60-99661 A | * | 6/1985 | B41J/3/04 |
| JP | 3-258554 | * | 11/1991 | B41J/2/175 |
| JP | 6-238909 A | * | 8/1994 | B41J/2/175 |
| JP | 9-109405 | * | 4/1997 | B41J/2/175 |

* cited by examiner

*Primary Examiner*—David F. Yockey
(74) *Attorney, Agent, or Firm*—Michael T. Sanderson; David E. LaRose

(57) ABSTRACT

A cartridge body contains one or more printheads on a first surface thereof and one or more connection apertures in flow communication with the one or more printheads, each aperture having an opening on a second surface opposite the first surface, and one or more separate ink filtration devices, each having an ink outlet port connected to the second surface of the cartridge body through an opening so that each ink outlet port is in flow communication with at least one connection aperture. The separate devices enable production of a cartridge body made of a material which is effective for removing heat from the printheads.

27 Claims, 7 Drawing Sheets

PRINTHEAD APPARATUS AND PRINTER HAVING SEPARATE FILTRATION DEVICE AND METHOD FOR ATTACHING SAID DEVICE

FIELD OF THE INVENTION

The invention relates to ink jet printers and in particular apparatus and methods for connecting a filter tower structure to a permanent or semi-permanent printhead.

BACKGROUND OF THE INVENTION

Ink jet printers and recorders are continually being improved to improve print speed and performance. However, some of the improvements cause difficulties in manufacturing and assembling of the components to one another. One area of improvement which has resulted in the need for different manufacturing techniques is the advent of high speed printheads which contain an increased number of nozzle holes and nozzle hole arrays as compared to earlier versions of such printheads. Such printheads are more costly to manufacture and thus are designed for longer life in order to reduce the cost of the consumable ink supply component of the printers. In the longer life printheads, one or more replaceable ink cartridges containing ink are attached to a cartridge body which contains one or more permanent or semi-permanent printheads.

The cartridge body may be made of a variety of materials including plastics, metals and composites containing ceramic or carbon components. A particularly preferred cartridge body is a metal cartridge body which is adapted to conduct heat away from the printheads during printing operations. The metal cartridge bodies contain a connection port or device in ink flow communication with the printheads for attaching a replaceable ink cartridge to the cartridge body. In order to protect the ink port from debris during ink cartridge replacement, a filtration device is used. Debris entering the ink port of the cartridge body has a detrimental effect on the operation of the printhead due to the size of ink passages leading to the nozzle arrays of the printheads. The ink filtration device is typically constructed separately from the cartridge body, and thus the filtration device must be attached to the cartridge body during a manufacturing operation.

An object of the invention is to provide an apparatus and method for connecting an ink filtration device to a cartridge body.

Another object of the invention is to provide a method for attaching a filtration device to a cartridge body which reduces the amount of debris which may occur during manufacturing steps therefor.

A further object of the invention is to provide a method for sealingly connecting a filtration device to a cartridge body for one or more printheads.

Still another object of the invention is to a relatively simple but effective means for aligning and connecting a filtration device to a cartridge body which enhances the manufacturing operation of permanent or semi-permanent printheads.

Another object of the invention is to provide an apparatus and method which improves the operation of an ink jet printhead.

SUMMARY OF THE INVENTION

With regard to the foregoing and other objects and advantages, the invention provides a printhead apparatus which includes a cartridge body containing one or more printheads on a first surface thereof, one or more connection apertures in flow communication with the one or more printheads, each aperture having an opening on a second surface opposite the first surface and one or more ink filtration devices having an ink outlet port connected to the second surface of the cartridge body through the opening so that each ink outlet port is in flow communication with at least one connection aperture.

In another aspect the invention provides an ink jet printer including one or more permanent or semi-permanent printheads on a cartridge body containing one or more printheads on a first surface thereof, one or more connection apertures in flow communication with the one or more printheads, each aperture having an opening on a second surface opposite the first surface, one or more ink filtration devices having an ink outlet port connected to the second surface of the cartridge body through the opening so that each ink outlet port is in flow communication with at least one connection aperture and one or more removable ink cartridges attached to the cartridge body, each cartridge containing an ink feed port for connection to the filtration device attached to the cartridge body between the cartridge and the cartridge body for filtering ink flowing to at least one of the printheads.

In yet another aspect the invention provides a method for attaching an ink filtration device to an ink feed port of an ink jet printer for providing filtered ink to one or more permanent or semi-permanent ink jet printheads which includes providing a cartridge body containing one or more printheads disposed on one surface thereof and having an aperture on a second surface thereof for each printhead for flow of ink to the printheads, providing an ink filtration device having a filter element attached to an ink feed port, aligning the filtration device with the aperture and sealingly inserting the ink feed port of the filtration device in the aperture to provide a cartridge body containing the filtration device.

An advantage of the apparatus and method of the invention is that the cartridge body and ink cartridge and filter elements may be constructed of different materials in order to enable better ink filtration and better heat conduction away from the printheads. Despite the difference in materials used for components of the printing devices, the manufacturing operation is relatively simple and the components may be attached to one another with little risk of damaging or blocking intricate ink flow paths in the printhead.

BRIEF DESCRIPTION OF THE DRAWINGS

Further features and advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

Figure 1:
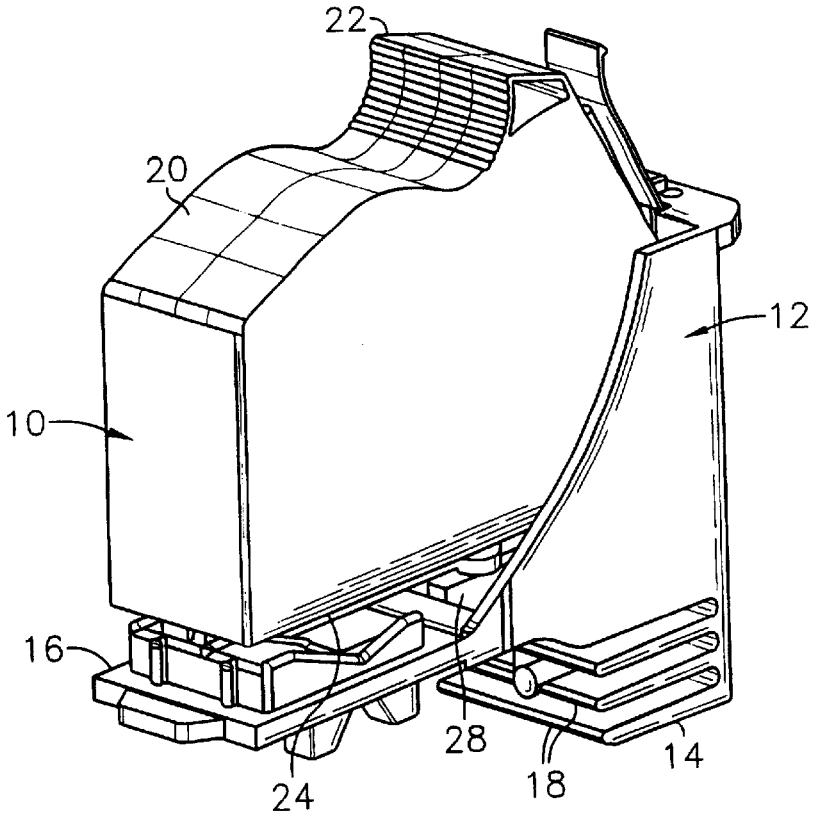
FIG. 1 is a perspective view of a removable ink supply cartridge assembled to a cartridge body for use in an ink jet printer.
Figure 2:
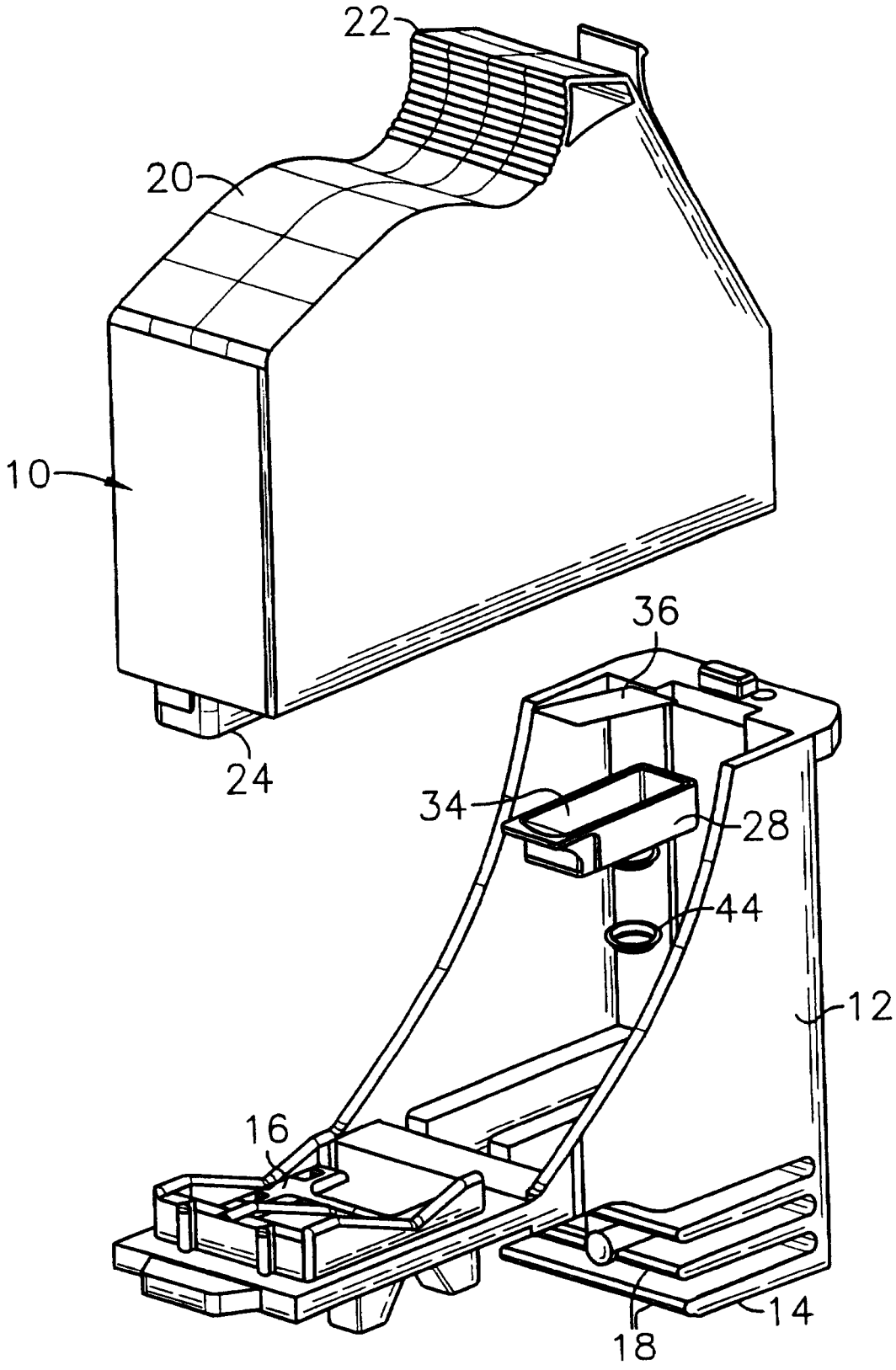
FIG. 2 is an exploded view in perspective of an ink supply cartridge, cartridge body and filtration device according to the invention.

With reference to FIGS. 1 and 2, there is shown, in perspective view, a replaceable ink cartridge 10 connected to a permanent or semi-permanent cartridge body 12. The ink cartridge 10 may contain a single color ink, such as black, cyan, magenta or yellow or may contain multiple colors of ink. The cartridge body 12 may be configured to attach to a single cartridge 10 or may be expanded to hold multiple cartridges 10. In the case of a single color ink cartridge 10, the cartridge body 12 typically contains a single printhead 14 on a side of the cartridge body 12 opposite the cartridge connection side 16 thereof. In the case of multiple cartridges 10 or multicolor cartridges 10, the cartridge body 12 may contain multiple printheads 14, typically three or four printheads 14.

In high speed, high quality printing operations, it is preferred that the cartridge body 12 be adapted to remove heat from the printhead. This may be accomplished by constructing the cartridge body 12 out of a heat conducting metal such as aluminum or zinc and/or by providing heat conducting fins 18 on the cartridge body 12 to conduct heat away from the printhead by conduction and convection.

With regard to the ink cartridge 10, the cartridge 10 is typically made of a plastic material such as polyethylene or polypropylene and has an upper portion 20 containing a handle 22 and a lower portion 24 which is attached adjacent the cartridge body 12. In the case of multi-color ink cartridges, the cartridge 10 may contain internal partitions which separate different color ink compartments from one another. In the alternative, as described above, multiple ink cartridges 10, each containing a different color ink may be attached to the cartridge body 12.

Figure 3:
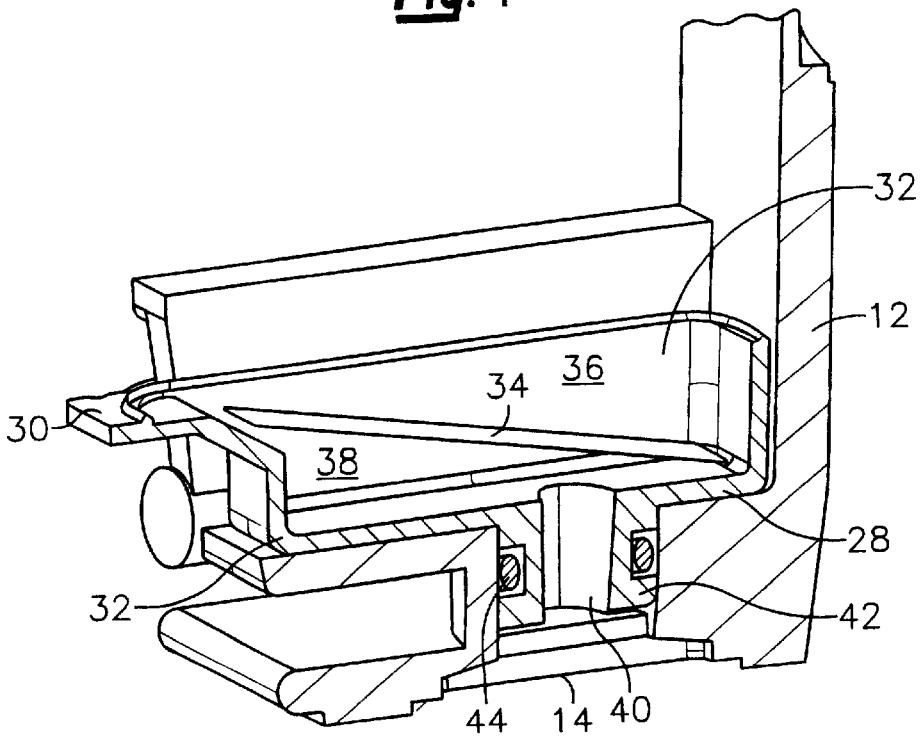
FIGS. 3, 4 and 5 are enlarged cross-sectional views of filtration devices connected to cartridge bodies according to the invention.

Another important feature of the invention is an ink filtration device 28 for filtering ink and minimizing the amount of debris that may enter the ink flow path adjacent printhead 14 (FIG. 3). The ink filtration device 28 includes a body portion 30 which includes a chamber 32 containing a filtration member 34 which separates an unfiltered ink area 36 from a filtered ink area 38. The filtered ink area 38 is in flow communication with a filtered ink outlet port 40 of filtration device 28. The filtered ink outlet port 40 is also in flow communication with the ink flow path feeding ink to the printheads 14.

In order to obtain a liquid and gas seal between a lower portion 42 of the filtration device 28 and the cartridge body 12, a flexible sealing member 44 is preferably used. A preferred sealing member 44 is an o-ring made of an elastomeric material such as ethylene-propylene diene (EPDM) rubber, platinum cured silicone rubber, thermoplastic elastomers or natural and synthetic rubbers which is resistant to ink used in an ink jet printer. Particular preferred sealing members are made of EPDM rubber or silicone rubber.

Figure 4:
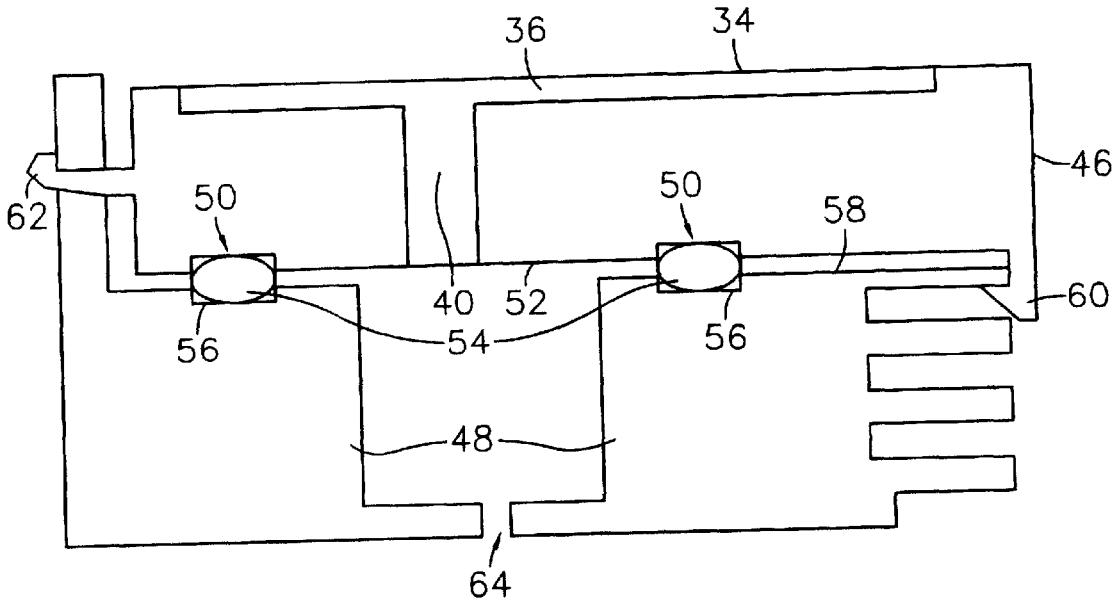

An alternative means for sealing between a filtration device 46 and cartridge body 48 is illustrated in FIG. 4. As shown in FIG. 4, there is a groove or channel 50 in the lower portion 52 of the filtration device 46 for retaining a sealing member such as o-ring 54. A corresponding groove or channel 56 is formed in the upper surface 58 of the cartridge body 48 for sealingly accepting o-ring 54 therein. The sealing member 54 is preferably made of the same material as sealing member 44 of FIGS. 2 and 3 and provides a liquid and gas tight seal between the lower portion 52 of the filtration device 46 and the upper surface 58 of the cartridge body 48 when the filtration device 46 is connected to the cartridge body 48.

The filtration device 46 may be attached to the upper surface 58 of the cartridge body 48 by means of flexible tab 60 and hook 62. Upon attachment of the filtration device 46 to the cartridge body 48, sealing member 54 is compressed so as to form a liquid and gas tight seal to prevent leakage of air into or ink out of ink flow path 64.

Figure 5:
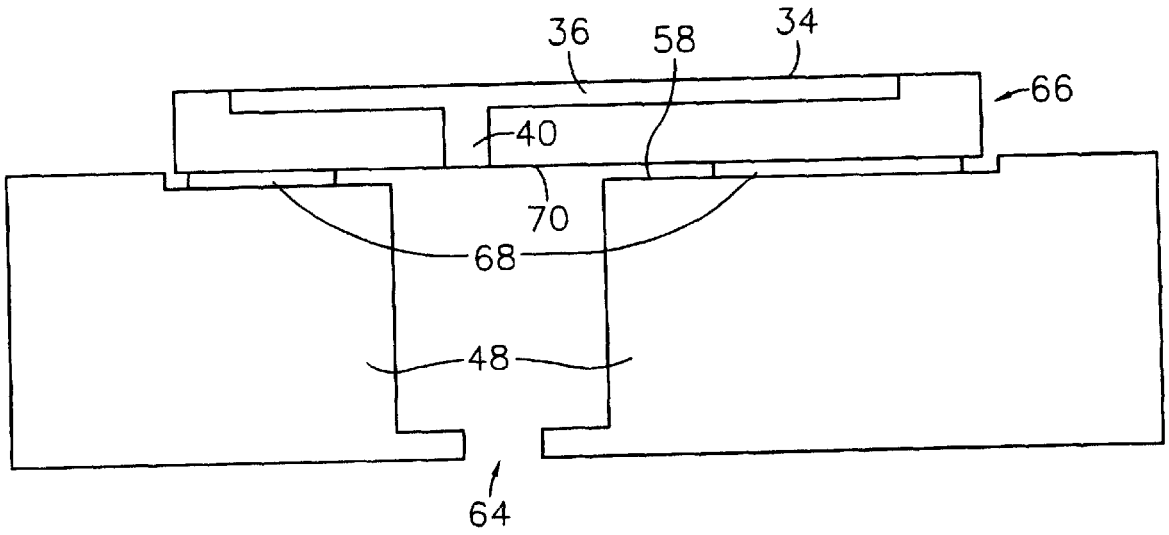

FIG. 5 illustrates another embodiment of the invention for connecting a filtration device 64 to a cartridge body 48. In this embodiment, the filtration device 66 is sealed to the top surface 58 of the cartridge body 48 using an adhesive 68 such as an epoxy, thermoplastic adhesive, urethanes and the like so wherein the adhesive 68 is disposed between the lower portion 70 of the filtration device 66 and the upper surface 58 of the cartridge body 48 around the periphery of the filtered ink flow path 40 and printhead ink flow path 64. Curing the adhesive provides a gas and liquid tight seal between the filtration device 66 and the cartridge body 48.

A further embodiment of the invention is illustrated in FIGS. 6–11. In this embodiment, the filtration device 80 is a generally cylindrical tower 82 which is inserted into an aperture in the cartridge body 84. The filter tower 82 comprises cylindrical body portion 86 having an upper peripheral edge 88 and a filter element 90 attached adjacent the upper peripheral edge 88. Several means which are described hereinafter may be used to attach the filter tower 82 to the cartridge body 84.

Figure 6:
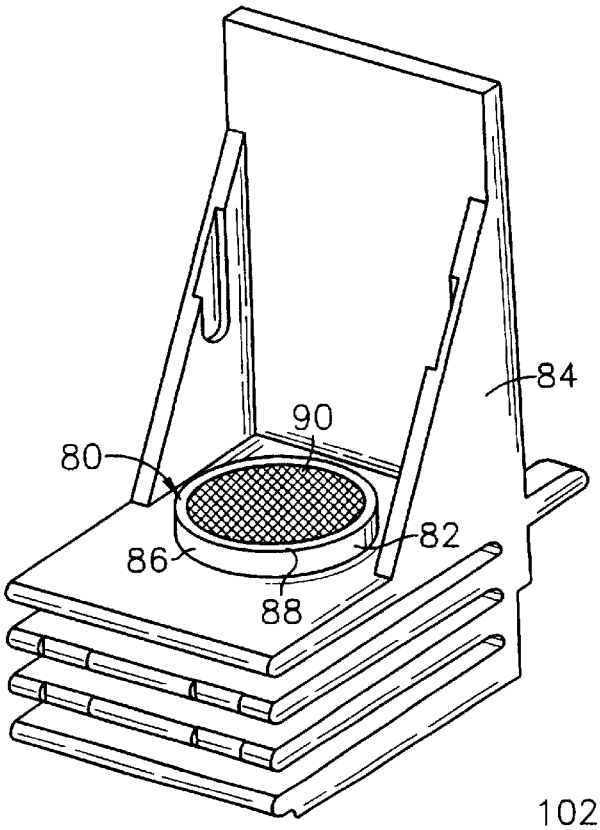
FIG. 6 is a perspective view of an alternative design of a filtration device connected to a cartridge body according to the invention.
Figure 7:
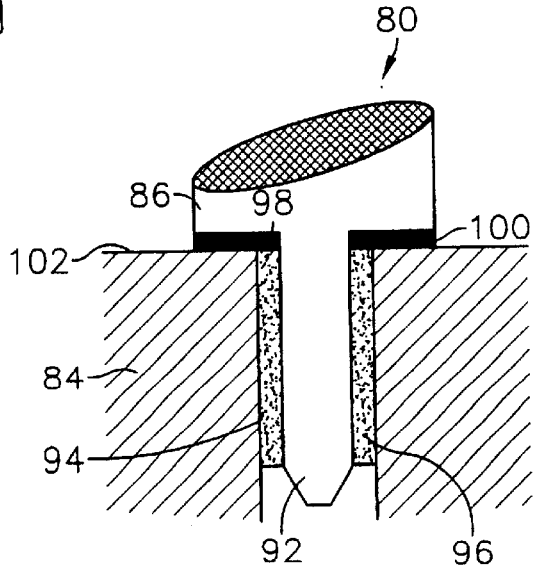
FIG. 7 and 8 are partial cross-sectional views showing connection means for filtration device according to the invention.

As shown in FIGS. 7–11, the filtration device 80 preferably includes a cylindrical stem 92 attached to the body portion 86, the stem 92 being in fluid flow communication with the body portion 86 as described in more detail below. The stem 92 of the filtration device 80 is preferably adapted for insertion into an aperture 94 in the cartridge body 84 (FIG. 6). The stem 92 is preferably sealed in the aperture 94 by applying a foam sealant material 96 such as an expandable urethane foam sealant available from Minnesota Mining and Manufacturing (3M) Corporation of Minneapolis, Minn. under the tradename ULTRAPRO. A lower surface 98 of body portion 86 is preferably attached by means of an adhesive 100 to an upper surface 102 of the cartridge body 84 (FIG. 6). A suitable adhesive 100 may be a dry film adhesive such as a thermoplastic bonding film available from 3M Corporation under the tradename Polyester #M615 EG, a thermoset bonding film available from National Starch and Chemical Corporation of Bridgewater, N.J. under the tradename ABLEFILM 550, an epoxy adhesive available from Emerson & Cuming, Inc. of Canton, Mass. under the tradename ECCOBOND 1962-31 or a thermally activated adhesive such as a phenol-formaldehyde resin adhesive such as BAKELITE BKS-2600 adhesive available from Georgia Pacific Resins, Inc. of Atlanta, Ga.

Figure 8:
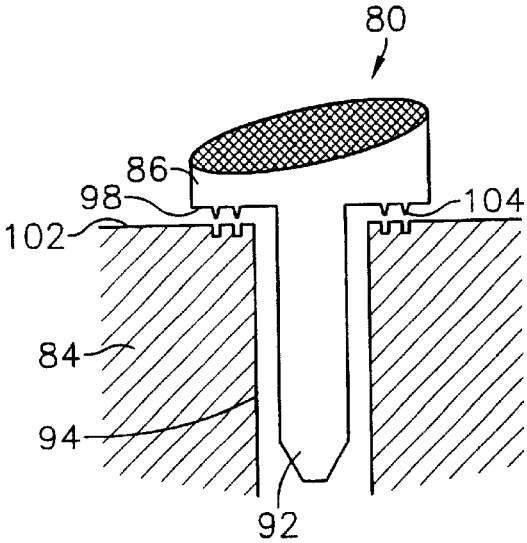

Another means for sealingly connecting a filtration device 80 to a cartridge body is illustrated in FIG. 8. In this embodiment, the lower surface 98 of the body portion 86 contains projections 104 which protrude from the lower surface 98 and encircle the stem 92. The projections may be in the form of protrusion rings 104 which align with grooves disposed in the upper surface 102 of the cartridge body 84 around the aperture 94 therein. A combination of heat and pressure and/or ultrasonic vibration are applied to the filtration device 80 to soften the protrusion rings 104 in order to form a mechanical bond between the lower portion of the body 86 and the upper surface 102 of the cartridge body 84. The number of protrusion rings 104 on the lower surface may range from 1 to 3 or more and is preferably at least about 2. The temperature applied to soften the protrusions preferably ranges from about 110° to about 290° C. and the pressure preferably ranges from about 0.5 to about 120 psig or higher. The protrusion rings 104 may also provide alignment of the filtration device 80 with the cartridge body 84.

Figure 9:
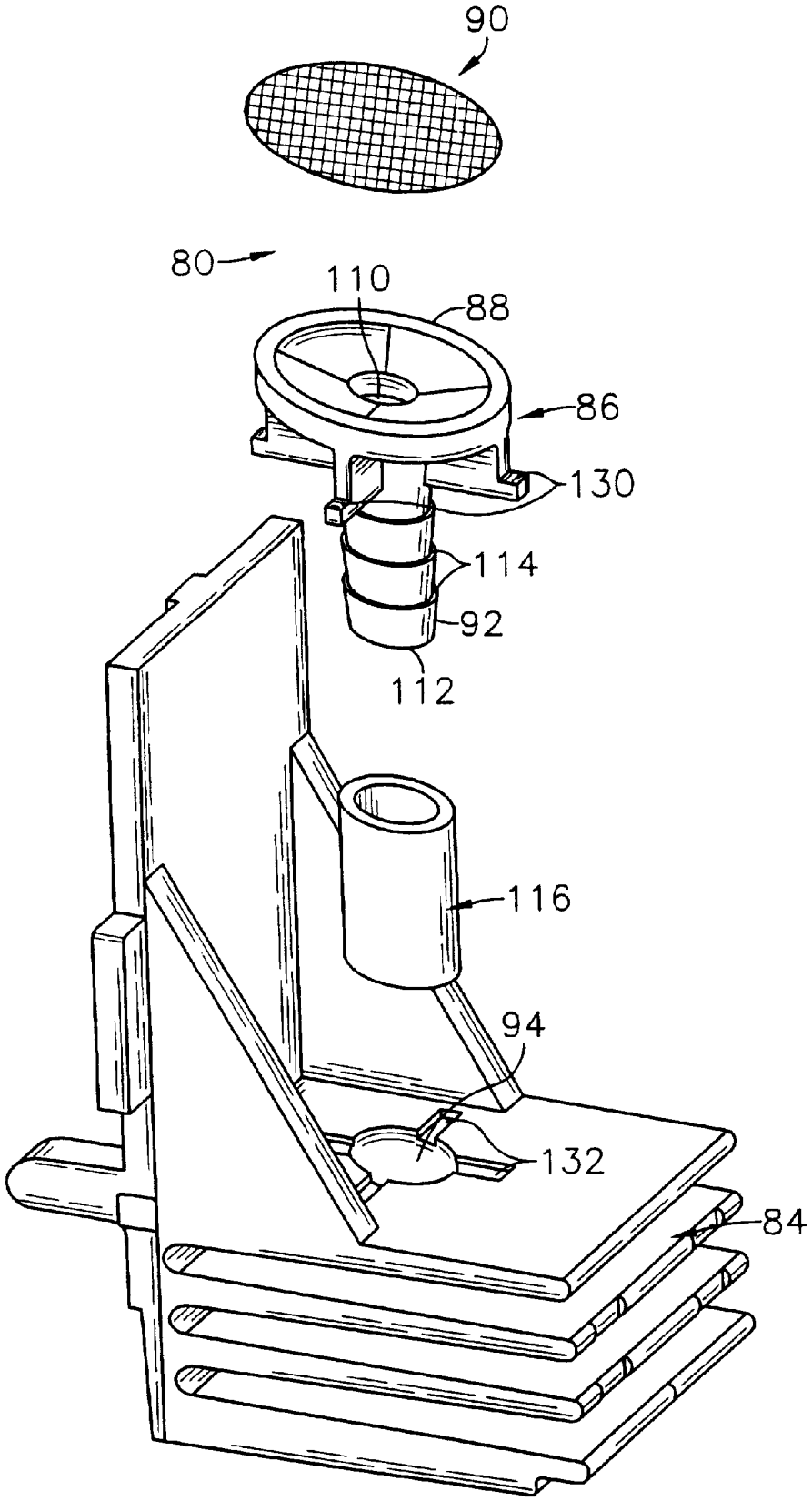
FIG. 9 exploded view in perspective of a filter tower and connection device according the invention.
Figure 10:
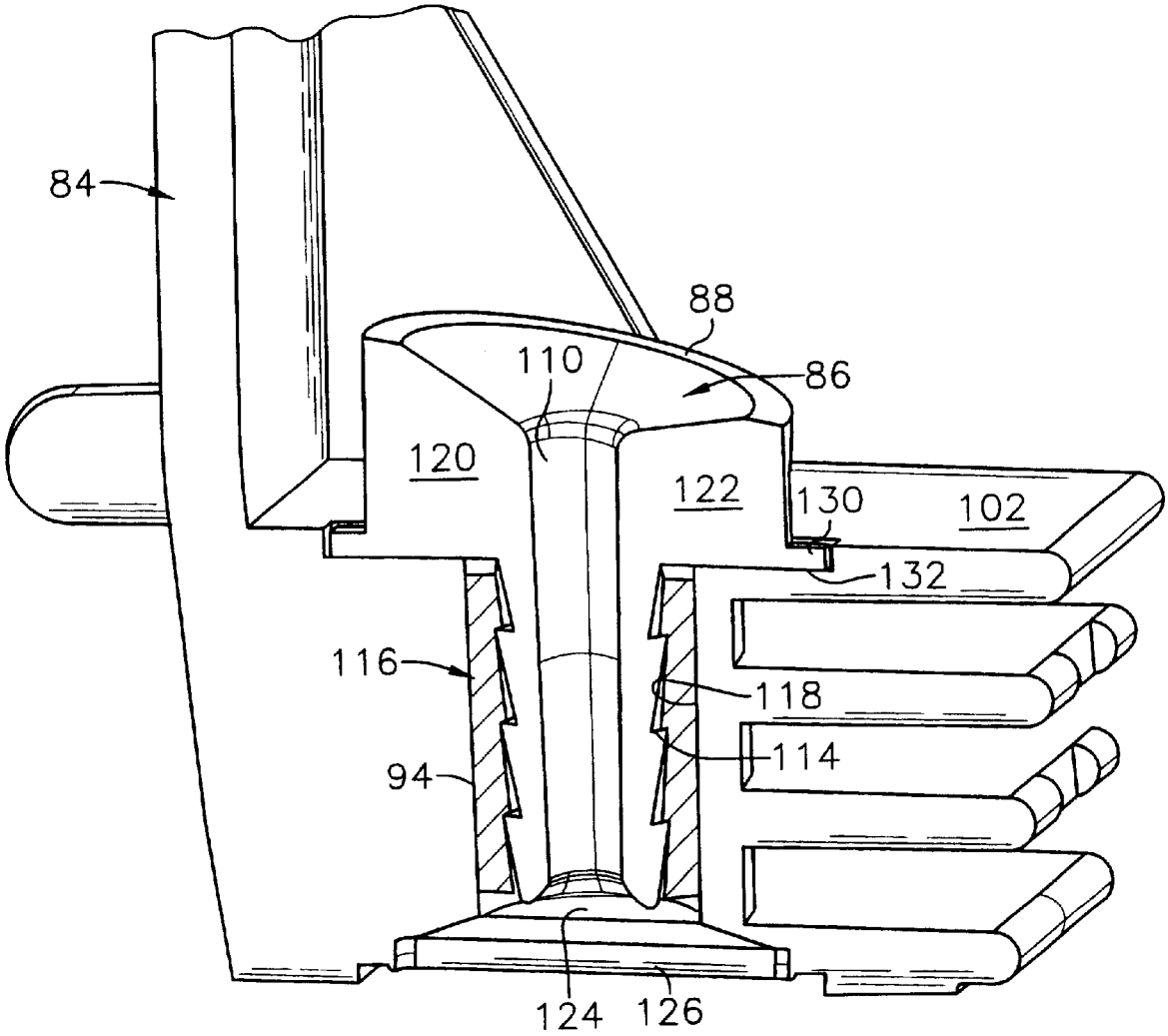
FIG. 10 cross-sectional view of a filtration device and connection to a cartridge body according to the invention.

FIGS. 9 and 10 illustrate yet another means for attaching a filtration device 80 to a cartridge body 84. As shown in exploded view, the filtration device 80 is a tower-like structure which includes a cylindrical upper body 86 having an upper peripheral edge 88 to which a mesh-like filter element 90 is attached. The filter element 90 may be made from stainless steel, woven fiberglass, nylon mesh or any other suitable filtration media which is resistant to chemical attack of the ink and is attached to the upper peripheral surface 88 by means of adhesives, heat staking, ultrasonic welding and the like. The mesh size of the filter element 90 is preferably selected to allow particles having an effective diameter ranging from about 0.1 $\mu$m to about 50 $\mu$m, most preferably from about 5 $\mu$m to about 10 $\mu$m to pass through the filter element.

Ink flowing through the filter element 90 enters the cylindrical upper body 86 and flows through a filtered ink flow path 110 extending axially from the upper portion of body 86 through a stem portion 92 and out an exit port 112. The exterior of the stem 92 preferably contains palls or barbs 114 which urge an elastomeric member 116 in the shape of a bushing or collar against the inside walls 118 of aperture 94 (FIG. 10) to form a gas and liquid tight seal therebetween. As shown in FIG. 10, the palls or barbs 114 depress into the elastomeric material of the bushing or collar 116 thereby further sealing against liquid and gas flow therebetween. The elastomeric member 116 is preferably made of an elastomeric material, including, but not limited to, natural rubber, synthetic rubber, polyurethane foam, EPDM rubber, silicone rubber and the like, provided the material selected for the elastomeric member 116 is resistant to the ink and. effectively forms a seal to prevent ink or air leakage therethrough.

As shown in FIG. 10, it is preferred that the filter element 90 be disposed at an angle relative to an axis through filtered ink flow path 110. Accordingly, one side 120 of the upper body portion 86 is configured to provide a greater distance from the upper peripheral edge 88 to the upper surface 102 of the cartridge body than the distance from the upper peripheral edge 88 to the upper surface 102 on an opposing side 122 of the upper body portion 86. The angled filter element 90 is provided to assist in air removal from the filtered ink flow path 110 which may accumulate when the ink cartridge is run dry and/or upon replacement of the ink cartridge. Upon flow of ink into the filtration device 80, the ink is filtered to remove particles and debris by filter element 90 and the purified ink flows into the filtered ink flow path 110 for flow to an ink flow path 124 adjacent to printhead 126.

Connection of the filtration device 80 to a cartridge body 84 may be effected by inserting the stem 92 into opening or aperture 94 in the cartridge body 84 which contains an elastomeric bushing or collar 116. In order to properly align the filtration device 80 with the cartridge body 84 upon insertion of the filtration device 80 into aperture 94, it is preferred that the body portion 86 contain one or more alignment tangs or prongs 130 which are adapted for mating with one or more alignment grooves 132 in the upper surface 102 of the cartridge body 84. The tangs or prongs 130 may also be used during assembly to press the filtration device 80 into the cartridge body 84 by use of an insertion tool which engages the tangs or prongs 130 of the filtration device 80. Such an insertion tool may include a rigid tube having a diameter larger than the outer peripheral diameter of the upper body portion 86. The alignment tangs or prongs 130 may also be adhesively attached or welded to the alignment grooves 132 to further fixedly attach the filtration device 80 to the cartridge body 84.

Figure 11:
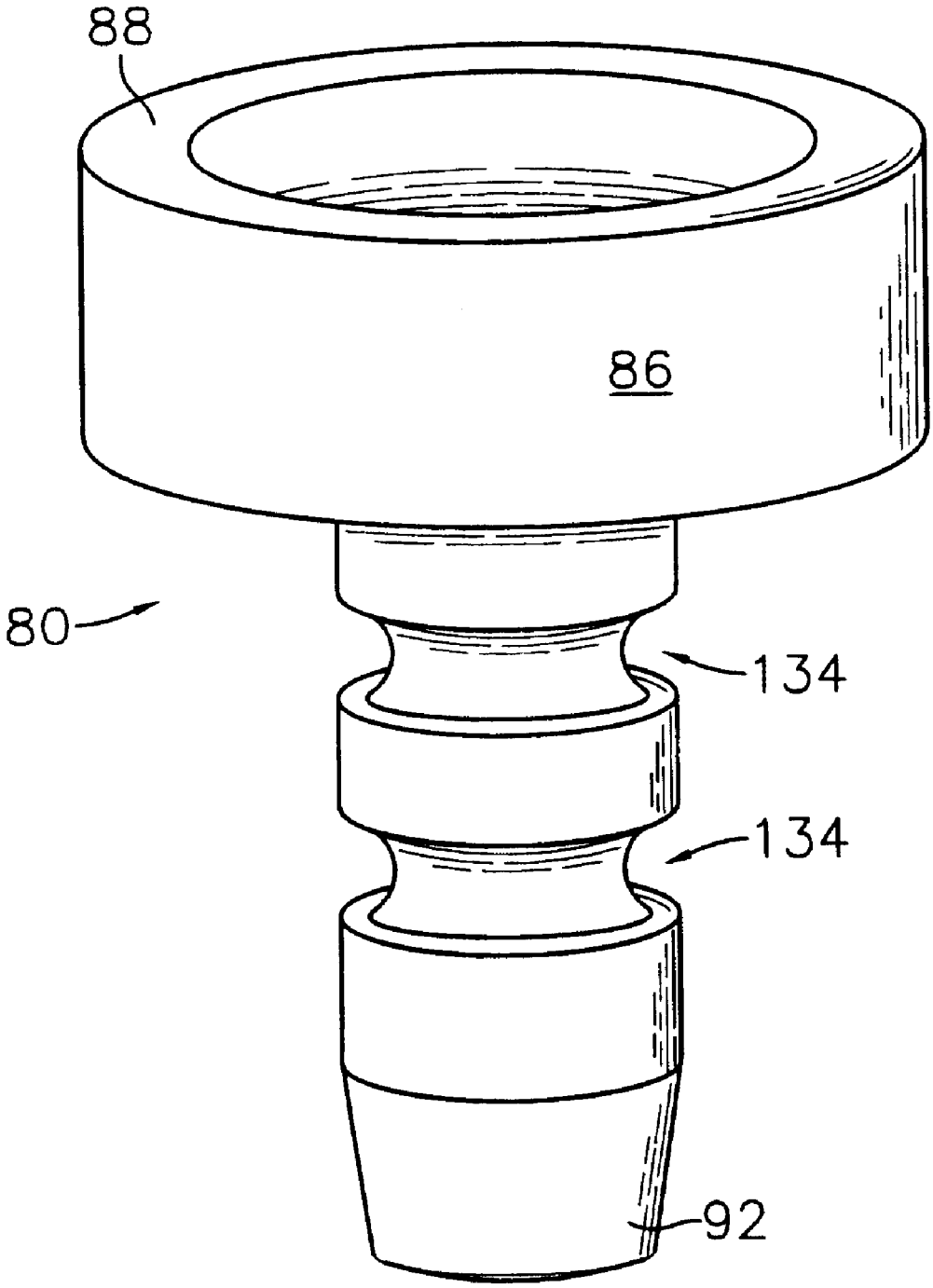
FIG. 11 is a perspective view of another filter tower design according to the invention.

Another preferred method of sealing the filtration device 80 in the aperture 94 of the cartridge body 84 is by means of elastomeric o-rings as described with reference to FIGS. 2, 3 and 4 above or by disposing one or more o-rings around the stem 92 in one or more grooves 134 (FIG. 11). Like the collar or bushing 116, elastomeric o-rings disposed in grooves 134 engage the inside walls 118 of aperture 94 (FIG. 10) to form a gas and liquid tight seal therebetween.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A printhead apparatus which comprises a cartridge body containing one or more printheads on a first surface thereof, a single connection aperture in flow communication with each of the one or more printheads, said aperture having an opening on a second surface opposite the first surface and at least one separate ink filtration device containing an angled filter element, the filtration device having a tubular ink outlet port connectable to said aperture through the opening on the second surface of the cartridge body so that said ink outlet port is in flow communication with one of the one or more printheads wherein the filtration device is constructed of a different material than the cartridge body.

2. The apparatus of claim 1 wherein said tubular ink outlet port further comprises barbs or palls.

3. The apparatus of claim 2 wherein a resilient sealing member is disposed in said connection aperture for sealingly engaging said barbs or palls.

4. The apparatus of claim 1 wherein said tubular ink outlet port is sealingly attached in said connection aperture by means of an adhesive.

5. The apparatus of claim 1 wherein said aperture contains an elastomeric o-ring disposed therein for sealingly engaging said tubular ink outlet port.

6. The apparatus of claim 1 wherein said aperture further comprises one or more alignment grooves disposed around the periphery thereof.

7. The apparatus of claim 6 wherein each ink filtration device further comprises at least one tongue for connective alignment with at least one of the one or more grooves.

8. The apparatus of claim 1 wherein each ink filtration device is sealingly connected to the second surface of the cartridge body by means of an adhesive.

9. The apparatus of claim 1 wherein each ink filtration device further comprises an elastomeric o-ring seal for sealingly engaging the second surface of the cartridge body.

10. An ink jet printer comprising a cartridge body constructed of a heat conducting material for conducting heat away from one or more permanent or semi-permanent printheads mounted on a first surface of the cartridge body, at least one connection aperture in flow communication with each of the one or more printheads, said aperture having an opening on a second surface opposite the first surface, at least one ink filtration device having a tubular ink outlet port connectable to said aperture through the opening on the second surface of the cartridge body so that each ink outlet port is in flow communication with one of the one or more printheads, said filtration device having an angled filter element, and at least one removable ink cartridge attached to the cartridge body, each cartridge containing an ink feed port for connection to said filtration device attached to the cartridge body between the cartridge and the cartridge body for filtering ink flowing to at least one of the one or more printheads.

11. The printer of claim 10 wherein said aperture further comprises one or more alignment grooves disposed around the periphery thereof.

12. The printer of claim 11 wherein said ink filtration device further comprises one or more tongues for connective alignment with the one or more grooves.

13. The printer of claim 10 wherein said tubular ink outlet port further comprises barbs or palls.

14. The printer of claim 13 wherein a resilient sealing member is disposed in said aperture for sealingly engaging said barbs or palls.

15. The printer of claim 10 wherein said tubular ink outlet port is sealingly attached by means of an adhesive.

16. The printer of claim 10 wherein said aperture contains an elastomeric o-ring disposed therein for sealingly engaging said tubular ink outlet port.

17. The printer of claim 10 wherein said ink filtration device is sealingly connected to the cartridge body by means of an adhesive.

18. The printer of claim 10 wherein said ink filtration device further comprises an elastomeric o-ring seal for sealingly engaging said cartridge body.

19. A method for attaching an ink filtration device to an ink feed port of an ink jet printer for providing filtered ink to at least one permanent or semi-permanent ink jet printhead which comprises providing a cartridge body containing at least one printhead disposed on one surface thereof and having an aperture on a second surface thereof for said printhead for flow of ink to said printhead, providing an ink filtration device containing an angled filter element attached thereto and a tubular ink feed port, aligning the filtration device with said aperture and sealingly inserting the ink feed port of the filtration device in said aperture to provide a cartridge body containing the filtration device, wherein the filtration device is constructed of a different material than the cartridge body.

20. The method of claim 19 further comprising inserting a resilient sealing member in said aperture of the cartridge body for sealingly engaging the tubular ink feed port.

21. The method of claim 20 wherein said tubular ink feed port contains barbs or palls for compressing the resilient sealing member against an inside surface of said aperture.

22. The method of claim 19 further comprising attaching said tubular ink feed port to said aperture by means of an adhesive.

23. The method of claim 19 wherein said aperture contains an elastomeric o-ring disposed therein for sealingly engaging said tubular ink feed port.

24. The method of claim 19 wherein said aperture contains one or more alignment grooves in the second surface of the cartridge body disposed around the periphery of said aperture.

25. The method of claim 24 wherein said ink filtration device contains one or more tongues, the method further comprising aligning the one or more tongues with a corresponding groove while connecting said ink filtration device to the cartridge body.

26. The method of claim 19 further comprising connecting said ink filtration device to the second surface of the cartridge body by means of an adhesive.

27. The method of claim 19 wherein said ink filtration device contains an elastomeric o-ring seal on a sealing surface adjacent the second surface of the cartridge body, the method further comprising sealingly connecting said ink filtration device to the cartridge body by compressing the o-ring seal between the second surface of cartridge body and the sealing surface of ink filtration device.

* * * * *